US005570829A

United States Patent [19]

Harrison

[11] Patent Number: 5,570,829

[45] Date of Patent: Nov. 5, 1996

[54] BACKPACK FOR CARRYING A FOLDABLE CHAIR

[76] Inventor: Rebecca Harrison, 102 Virginia St., Apt. 1, El Segundo, Calif. 90245

[21] Appl. No.: 467,772

[22] Filed: Jun. 6, 1995

Related U.S. Application Data

[63] Continuation-in-part of Ser. No. 227,635, Apr. 14, 1994, abandoned.

[51] Int. Cl.[6] ..... A45F 4/02

[52] U.S. Cl. ..... 224/651; 224/657; 224/658; 224/153; 224/155; 190/8; 150/158

[58] Field of Search ..... 224/205, 151, 224/153, 154, 155, 156, 209, 210, 901, 148, 627, 645, 650, 651, 653, 654, 657, 658; 190/8; 150/158; 297/16.1, 21, 34, 45

[56] References Cited

U.S. PATENT DOCUMENTS

| | | | |
|---|---|---|---|
| 445,190 | 1/1891 | Nicolay | 297/34 |
| 1,951,604 | 3/1934 | Friedlander . | |
| 2,475,135 | 7/1949 | Haven | 224/651 |
| 3,158,299 | 11/1964 | Weir et al. . | |
| 4,003,455 | 1/1977 | Cortese . | |
| 4,236,657 | 12/1980 | Brunton . | |
| 4,673,117 | 6/1987 | Calton . | |
| 4,887,751 | 12/1989 | Lehman . | |
| 4,972,981 | 11/1990 | Gex . | |
| 4,979,613 | 12/1990 | McLaughlin et al. . | |
| 5,004,134 | 4/1991 | Barry . | |
| 5,048,734 | 12/1991 | Long . | |
| 5,050,998 | 9/1991 | Wachtel | 224/209 |
| 5,054,848 | 10/1991 | Liu | 297/16.1 |
| 5,090,526 | 2/1992 | Jacober . | |
| 5,216,900 | 6/1993 | Jones . | |

FOREIGN PATENT DOCUMENTS

| | | |
|---|---|---|
| 28 25 366 | 12/1979 | Germany . |
| 699602 | 11/1953 | United Kingdom . |
| 1238303 | 7/1971 | United Kingdom . |

OTHER PUBLICATIONS

Self–Adhering Nylon Tapes; Journal of AMA, vol. 168, No. 7, Oct. 18, 1958.

*Primary Examiner*—Henry J. Recla
*Assistant Examiner*—Gregory M. Vidovich
*Attorney, Agent, or Firm*—Poms, Smith, Lande & Rose Professional Corporation

[57] ABSTRACT

A backpack which may be used to carry a folding chair including front and rear members, a connecting device for releasably connecting the front and rear members to one another thereby forming an internal cavity, and a fastening device, associated with the internal cavity, for releasably securing the foldable chair within the cavity. The backpack may also include a plurality of storage compartments, including an insulated storage compartment for food and beverages.

19 Claims, 2 Drawing Sheets

BACKPACK FOR CARRYING A FOLDABLE CHAIR

CROSS-REFERENCE TO RELATED APPLICATIONS

This application is a continuation-in-part of U.S. patent application Ser. No. 08/227,635, filed Apr. 14, 1994, now abandoned.

BACKGROUND OF THE INVENTION

1. Field of Invention

The present invention relates generally to a backpack and, more particularly, to a backpack which is adapted to store a foldable beach chair.

2. Description of the Related Art

Backpacks are useful in for carrying large numbers of small items. For example, backpacks are often used to carry magazines, food, towels and other items to beaches and parks. This is especially true when people travel by motorcycle or bicycle, because both hands must be free to operate the vehicle. Even for those who chose to walk, carrying items by hand eventually becomes tiresome. Accordingly, the use of backpacks of various shapes and sizes has become common.

One item which is regularly taken to beaches and parks is a foldable beach chair. Such foldable beach chairs typically include a pair of U-shaped leg members, a horizontal support, a pair of arm rests and an upwardly extending back support. The beach chair may be folded into a compact orientation where the leg members and arm rests lie one on top of the other and the horizontal support and back support lie one on top of the other therebetween.

Unfortunately, most backpacks are not designed to accommodate any type of foldable chair within the backpack and it is believed that no backpacks have been proposed which are designed to carry a foldable beach chair, in a folded orientation, and in such a manner that the backpack may also be used to conveniently carry other items typically taken to beaches, parks, etc. As such, foldable beach chairs must be carried by hand or, when traveling by bicycle or motorcycle, left at home.

A number of unsatisfactory attempts have been made to provide backpacks which may be used to carry foldable beach chairs. For example, U.S. Pat. No. 5,004,134 to Barry discloses a pair of fastening straps which are used to hang a foldable chair from the outside of the backpack. The chair is free to swing back and forth in such a manner that it will repeatedly strike the backpack, thereby annoying the user. Moreover, should the fastening straps fail, the chair will simply fall off the backpack. Because people instinctively try to grab falling objects, such strap failure could lead to injury should it occur during a bicycle or motorcycle ride. Also, sharp metal or plastic edges on the chair are exposed and could lead injury.

U.S. Pat. No. 4,972,981 to Gex discloses a backpack for carrying a foldable chair which consists essentially of an elongate piece of material and four pairs of straps, one on each side and two on top. In use, the material is folded about the chair and the straps are then secured. Should one of the side straps come undone or fail, it is likely that the chair will fall out of the backpack, thereby leading to the undesirable consequences discussed above. Additionally, sharp edges on the chair are dangerously exposed. Moreover, the open style of the '981 backpack does not allow for the storage of other items in the same "compartment" as the chair. Rather, the '981 backpack only provides a small additional pocket.

Two other unsatisfactory attempts to carry foldable chairs are disclosed in German Offenlegungsschrift 2,825,366 (published Dec. 12, 1979) and English Patent Specification 699,602 (published Nov. 11, 1953). Here, the foldable chairs are not of the type referred to herein as a beach chair. Instead, they define a generally rectangular overall shape and lack a back support. Sitting on such chairs is tantamount to sitting on a box. The chairs are shaped in this manner because they are intended to be stored in an unfolded orientation so that they may act as a rigid rectangular frame for the sacks. Due to the frame, the sacks may not be substantially deformed when carrying a chair. Thus, they are unsuitable for situations where they may have to be deformed to, for example, fit behind the seat of a car.

Cold food and beverages are also often taken to beaches and parks. However, the prior art lacks a simple, lightweight method of providing an insulated area in a backpack. For example, the aforementioned '134 patent is adapted to store an entire ice chest. Such an arrangement is costly, impractical for small amounts of cold food, and occupies a significant amount of the total storage space of the backpack.

SUMMARY OF THE INVENTION

The general object of the present invention is to provide an improved backpack to obviate, for practical purposes, the aforementioned problems in the art. More particularly, one object of the present invention is to provide a backpack which is adapted to store a foldable chair in such a manner that the chair will not swing back and forth during use. Another object of the present invention is to secure the chair in such a manner that the danger of the chair falling out of the backpack is substantially reduced. A further object of the present invention is to store a foldable beach chair in a folded orientation within a backpack. A still further object of the present invention is to provide a backpack which is adapted to store cold items in addition to foldable chairs.

In order to accomplish these and other objectives, a backpack is provided which may include front and rear members, a connector for releasably connecting the front and rear members to one another, thereby defining a closed internal cavity, and a fastening system, associated with the internal cavity, for releasably securing the foldable chair to at least one of the front and rear members in a folded orientation.

This aspect of the present invention provides a number of advantages over the prior art. For example, a foldable chair carried by the present invention are not only secured to the backpack, it is also secured within the backpack. Thus, even if the fastener fail during use, the chair will not fall from the backpack. Additionally, because the chair is secured within the backpack itself, hazardous sharp edges will not be exposed and the chair will not swing back and forth during use. Finally, as the chair is stored in a folded orientation, the backpack may be easily deformed if necessary.

The present invention may also be provided with a flexible, insulated pocket for storing cold food and beverages as well as a number of other pockets and/or pouches for carrying items such as books, magazines, money, clothing, towels, suntan lotion and other items. Such pockets and pouches may be either internal or external. Accordingly, the present backpack may be used to carry everything necessary for a day at the beach or park in such a manner that the user can easily travel by foot, bicycle or motorcycle.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiment of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
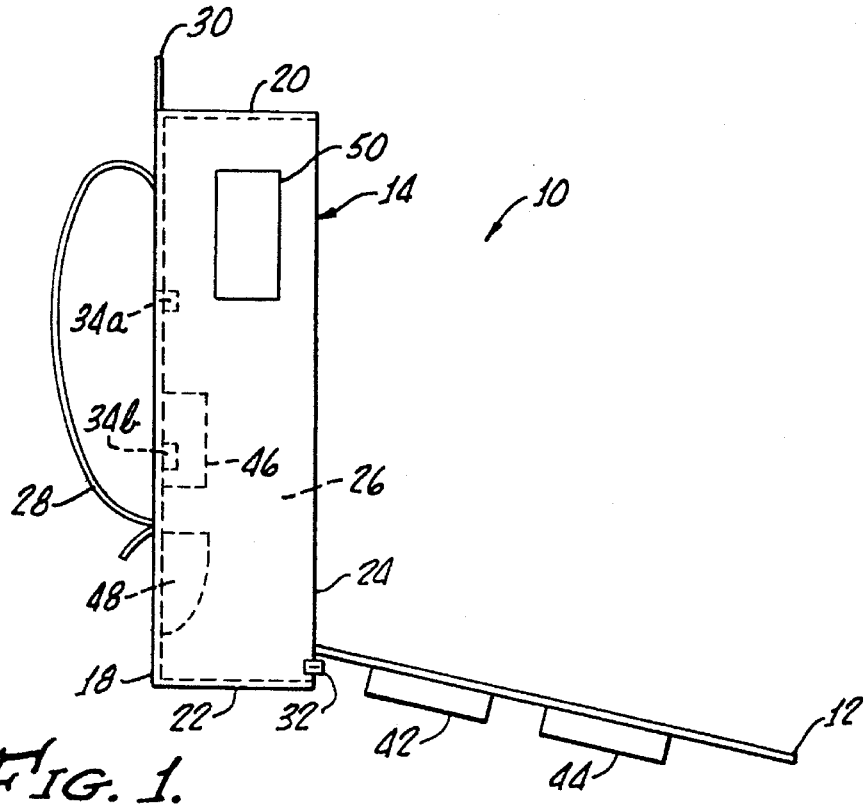
FIG. 1 is a side elevation view of a backpack in accordance with a preferred embodiment of the present invention.
Figure 2:
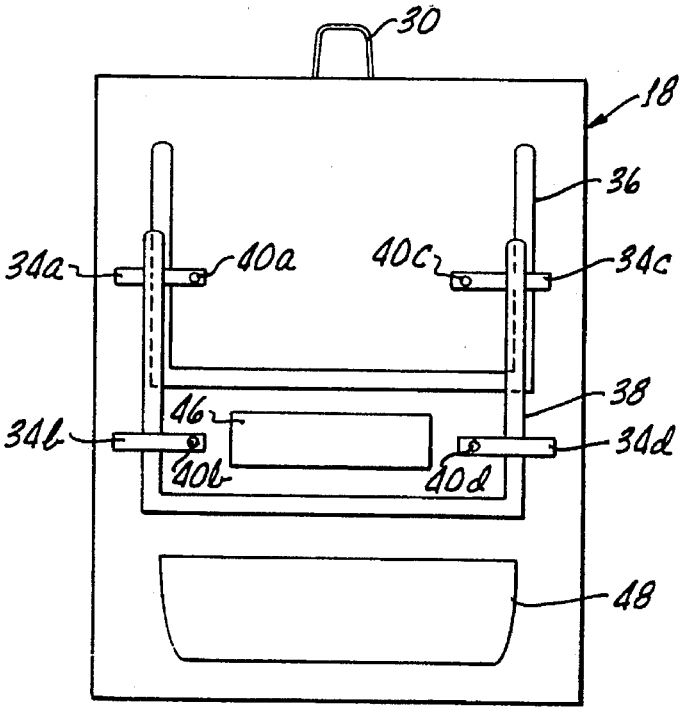
FIG. 2 is a front elevation of a portion of the preferred embodiment illustrated in FIG. 1.

A preferred embodiment of a backpack in accordance with the present invention is illustrated, for example, in FIGS. 1 and 2. The backpack 10, for carrying a foldable chair such as a beach chair, includes a front member 12 which is attached to a rear member 14. The rear member 14 may include a rear panel 18, top and bottom panels 20 and 22, respectively, and side panels 24, which together form a cavity 26. Although the illustrated embodiment defines a generally rectangular shape, the backpack is not limited to such a shape. For example, the top corners may be rounded. Also, as the materials used to form the backpack (vinyl, nylon, cotton, corduva, etc.) are generally deformable, the backpack will deform slightly during use. A pair of adjustable shoulder straps 28 and a hanging hook 30 are attached to the rear panel 18.

Figure 5:
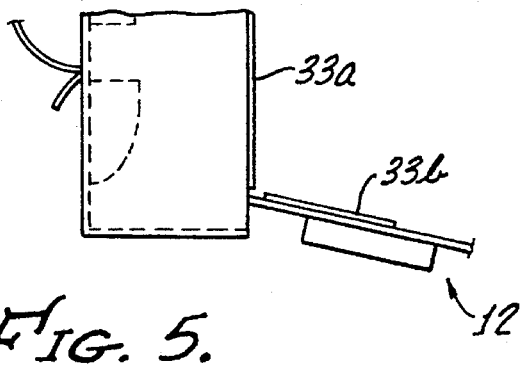
FIG. 5 is a partial perspective view of a backpack in accordance with the preferred embodiment illustrated in FIG. 1 having adhesive tape type connector.

The remaining edge portions front member 12 and rear member 14 may be attached to one another by a connecting means to close the cavity 26. In accordance with the preferred embodiment, the connecting means may be a zipper 32, adhesive tape such as Velcro™ (see elements 33*a* and 33*b* in FIG. 5), or a series of buttons.

The backpack also includes fastening means for releasably securing a foldable chair to a portion of the backpack within the cavity 26. As noted above, foldable chairs often include a pair of generally U-shaped leg members, which are pinned at their respective free ends to an arm rest, a lower support and a back support. Referring for example to FIGS. 1 and 2, the connecting means may include a plurality of fastening straps 34*a*–34*d* to secure U-shaped leg members 36 and 38 of the foldable chair to the rear panel 18. Each strap may be secured to the rear panel 18 at one end and include a fastening element (40*a*–40*d*) at the other end. The fastening element may consist of fastening tape, snaps, hook and eye arrangements, buttons, quick release devices or other such releasable fasteners.

As illustrated, for example, in FIG. 1, the outer portion of the front member 12 may include an insulated storage compartment 42 for storing cold food and a storage compartment 44 for storing items such as magazines. The insulating material used to insulate the compartment 42 may be foam insulation, or other commonly used insulating materials known to those of skill in the art. Additional storage capability may be provided within the backpack in the form of a storage compartment 46 and a pouch 48 (FIG. 2). Finally, an additional storage compartment 50 is provided on one of the side panels 24. The storage compartments may be opened and closed by means of fastening tape, such as Velcro™, or zippers, and are formed from the same types of material as the backpack itself. The pouch 48 is opened at the top and formed from net-like material. As such, it is especially useful for carrying towels, clothing and other items which may be damp.

Figure 3:
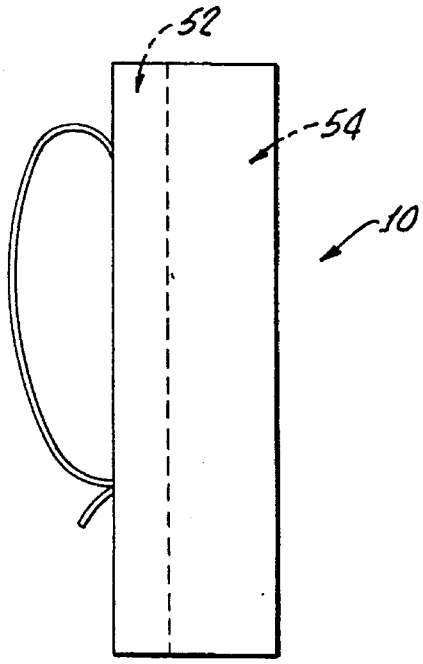
FIG. 3 is a schematic side elevation view showing a preferred location of a folded chair within the preferred embodiment.

As shown by way of example in FIG. 3, the space within backpack 10 may viewed as two adjacent spaces. A folded chair may be located in the first space, which is generally indicated by reference numeral 52. The second space, generally indicated by reference numeral 54, may be used to store items such a clothing, towels, etc. When the second space is empty, the backpack may deformed to the point at which the thickness of the pack will be substantially equal to the thickness of a chair to allow the backpack to fit into a relatively small space. The backpack may also be deformed when articles are stored in the second space to the extent that the articles themselves, such as towels and clothes, may be deformed. It should be noted that the respective shapes and sizes of the chair storage space 52 and the generally open, unobstructed space 54 are not limited to that shown in FIG. 3. Rather, they will vary according to the shape and size of the chair and the backpack.

Figure 4:
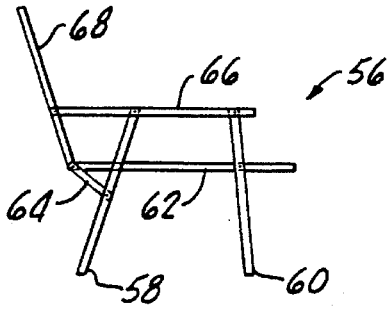
FIG. 4 is a schematic side elevation view of an exemplary foldable beach chair.

Finally, one example of a foldable beach-type chair 56 which may be carried by the present backpack is illustrated in FIG. 4. The chair includes a pair of generally U-shaped leg members 58 and 60, one of which is pinned to a horizontal support 62. The other is pinned to a hinge 64. Both leg members are pinned to a pair of arm rests 66 (one of which is not shown). An upwardly extending back support 68 is pinned to the horizontal support, the hinge and the arm rests. The pins allow the chair to be reoriented from the unfolded orientation shown in FIG. 4 to a folded orientation where the chair will be substantially flat. It should be noted that the present invention is not limited to the beach-type chair shown. Rather, any foldable beach-type chair may be used.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A backpack and foldable chair system, comprising:

a foldable chair, adjustable between a folded orientation for storage and an unfolded orientation for use and including at least first and second substantially U-shaped legs, the foldable chair being in the folded orientation; and a backpack for storing the foldable chair including (a) a front member;

(b) a rear member including a rear panel and at least one shoulder strap associated with the rear panel for securing the backpack to a user's shoulder;

(c) a connector, associated with the front and rear members, for releasably connecting the front and rear members to one another, the front and rear members defining a closed internal cavity when connected by the connector, the closed internal cavity including a chair storage space adjacent to the rear panel and a substantially unobstructed storage space located substantially between the chair storage space and the front member; and (d) fastening means, associated with the internal cavity, for separately releasably engaging and securing each of the substantially U-shaped legs to at least one of the front and rear members such that the foldable chair is maintained in the folded orientation, the chair being entirely within the chair storage space when engaged and secured by the fastening means.

2. A backpack and foldable chair system as claimed in claim 1, wherein the rear member further includes two side panels, a top panel and a bottom panel and the connector comprises a zipper associated with the two side panels, the top panel and the front member.

3. A backpack and foldable chair system as claimed in claim 1, wherein the rear member further includes two side panels, a top panel and a bottom panel and the connector comprises adhesive tape associated with the two side panels, the top panel and the front member.

4. A backpack and foldable chair system as claimed in claim 1, wherein the fastening means comprises first and second fastening straps and fastening elements associated with the fastening straps, the first fastening strap being associated with the first substantially U-shaped leg and the second fastening strap being associated with the second substantially U-shaped leg, the fastening elements being selected from the group consisting of fastening tape, snaps, hook and eye arrangements, buttons and quick release devices.

5. A backpack and foldable chair system as claimed in claim 1, wherein the fastening means is associated with the rear member and the rear member defines an inner side, the backpack further comprising:

a pouch formed on the inner side of the rear member, the fastening means and pouch being respectively arranged such that the foldable chair secured by the fastener will be located in spaced relation to the pouch.

6. A backpack and foldable chair system as claimed in claim 1, wherein the front member defines an outer side opposite the internal cavity, the backpack further comprising:

a first outer storage compartment associated with the outer side of the front member, the first outer storage compartment being composed of foam insulation.

7. A backpack and foldable chair system as claimed in claim 6, further comprising:

a second outer storage compartment, in spaced relation to the first storage compartment, associated with the outer side of the front member.

8. A backpack and foldable chair system as claimed in claim 1, wherein the fastening means comprises a plurality of fastening straps associated with the rear member, each strap including a first portion fixed to the rear member, a second portion extending over only one of the legs of the chair, and a third portion releasably secured to the rear member.

9. A backpack and foldable chair system as claimed in claim 8, further comprising:

a first inner storage compartment associated with the rear member and positioned such that it will be substantially between the legs of the chair fastened to the rear member.

10. A backpack and foldable chair system as claimed in claim 1, wherein the foldable chair comprises a horizontal support and a back support.

11. A backpack for carrying a foldable chair, adjustable between a folded orientation for storage and an unfolded orientation for use and including at least first and second substantially U-shaped legs, in the folded orientation, the backpack comprising:

a front member;

a rear member including a rear panel and at least one shoulder strap associated with the rear panel for securing the backpack to a user's shoulder;

a connector, associated with the front and rear members, for releasably connecting the front and rear members to one another, the front and rear members defining a closed internal cavity when connected by the connector, the closed internal cavity including a chair storage space adjacent to the rear panel and a substantially unobstructed storage space located substantially between the chair storage space and the front member; and fastening means, associated with the internal cavity, for separately releasably engaging and securing each of the substantially U-shaped legs to at least one of the front and rear members such that the foldable chair is maintained in the folded orientation, the chair being entirely within the chair storage space when engaged and secured by the fastening means.

12. A backpack as claimed in claim 11, wherein the rear member further includes two side panels, a top panel and a bottom panel and the connector comprises a zipper associated with the two side panels, the top panel and the front member.

13. A backpack as claimed in claim 11, wherein the rear member further includes two side panels, a top panel and a bottom panel and the connector comprises adhesive tape associated with the two side panels, the top panel and the front member.

14. A backpack as claimed in claim 11, wherein the fastening means comprises first and second fastening straps and fastening elements associated with the fastening straps, the first fastening strap being associated with the first substantially U-shaped leg and the second fastening strap being associated with the second substantially U-shaped leg, the fastening elements being selected from the group consisting of fastening tape, snaps, hook and eye arrangements, buttons and quick release devices.

15. A backpack as claimed in claim 11, wherein the fastening means is associated with the rear member and the rear member defines an inner side, the backpack further comprising:

a pouch formed on the inner side of the rear member, the fastening means and pouch being respectively arranged such that the foldable chair secured by the fastener will be located in spaced relation to the pouch.

16. A backpack as claimed in claim 11, wherein the front member defines an outer side opposite the internal cavity, the backpack further comprising:

a first outer storage compartment associated with the outer side of the front member, the first outer storage compartment being composed of foam insulation.

17. A backpack for carrying a foldable chair as claimed in claim 16, further comprising:

a second outer storage compartment, in spaced relation to the first storage compartment, associated with the outer side of the front member.

18. A backpack as claimed in claim 11, wherein the fastening means comprises a plurality of fastening straps associated with the rear member, each strap including a first portion fixed to the rear member, a second portion extending over only one of the legs of the chair, and a third portion releasably secured to the rear member.

19. A backpack for carrying a foldable chair as claimed in claim 18, further comprising:

a first inner storage compartment associated with the rear member and positioned such that it will be substantially between the legs of the chair fastened to the rear member.

* * * * *